US005312498A

United States Patent [19]

Anderson

[11] Patent Number: 5,312,498

[45] Date of Patent: May 17, 1994

[54] METHOD OF PRODUCING AN ALUMINUM-ZINC-MAGNESIUM-COPPER ALLOY HAVING IMPROVED EXFOLIATION RESISTANCE AND FRACTURE TOUGHNESS

[75] Inventor: Kevin R. Anderson, Glen Allen, Va.

[73] Assignee: Reynolds Metals Company, Richmond, Va.

[21] Appl. No.: 930,110

[22] Filed: Aug. 13, 1992

[51] Int. Cl.[5] ..... C22F 1/04

[52] U.S. Cl. ..... 148/695; 148/698; 148/701; 148/417; 148/439; 420/532

[58] Field of Search ..... 148/695, 698, 701, 417, 148/439; 420/532

[56] References Cited

U.S. PATENT DOCUMENTS

| | | | |
|---|---|---|---|
| 3,881,966 | 5/1975 | Staley et al. | 148/698 |
| 4,305,763 | 12/1981 | Quist et al. | 148/694 |
| 4,828,631 | 5/1989 | Ponchel et al. | 148/695 |
| 4,954,188 | 9/1990 | Ponchel et al. | 148/417 |

*Primary Examiner*—R. Dean
*Assistant Examiner*—Robert R. Koehler
*Attorney, Agent, or Firm*—Alan M. Biddison

[57] ABSTRACT

A method of producing an aluminum-based alloy product having improved exfoliation resistance and fracture toughness which comprises providing an aluminum-based alloy composition consisting essentially of about 5.5–10.0% by weight of zinc, about 1.75–2.6% by weight of magnesium, about 1.8–2.75% by weight of copper with the balance aluminum and other elements. The aluminum-based alloy is worked, heat treated, quenched and aged to produce a product having improved corrosion resistance and mechanical properties. The amounts of zinc, magnesium and copper are stoichiometrically balanced such that after precipitation is essentially complete as a result of the aging process, no excess elements are present. The method of producing the aluminum-based alloy product utilizes either a one- or two-step aging process in conjunction with the stoichiometrically balancing of copper, magnesium and zinc.

25 Claims, 11 Drawing Sheets

METHOD OF PRODUCING AN ALUMINUM-ZINC-MAGNESIUM-COPPER ALLOY HAVING IMPROVED EXFOLIATION RESISTANCE AND FRACTURE TOUGHNESS

FIELD OF THE INVENTION

This invention relates to a method of producing an aluminum-based alloy product which is characterized by superior exfoliation resistance and fracture toughness. The method includes providing an aluminum-zinc-copper-magnesium alloy having controlled and generally stoichiometric amounts of copper, magnesium and zinc to minimize the presence of excess alloying elements in the alloy product.

BACKGROUND OF THE INVENTION

In the aircraft and aerospace industries, aluminum alloys are used extensively because of the durability of the alloys as well as a reduction in weight achieved by their use. Alloys in aircraft and aerospace industries must have excellent strength and elongation properties and superior exfoliation resistance and fracture toughness. A number of aluminum alloys have been developed for these industries to satisfy these needs. However, and in view of the continuing demands of the industry for weight reduction, increased strength to weight ratio requirements and improved performance in corrosive climatic conditions, a need has developed for an aluminum-based alloy having superior fracture toughness and exfoliation resistance. The present invention meets this need in the aircraft and aerospace industries by providing an aluminum-zinc-magnesium-copper alloy which contains controlled and stoichiometric amounts of copper, magnesium and zinc.

Aluminum alloys are known in the art which contain zinc, magnesium and copper. In particular, AA 7000 series have been developed for particular use in aircraft and aerospace applications. AA 7150, as registered with the Aluminum Association, includes 1.9–2.5% by weight of copper, 2.0–2.7% by weight of magnesium and 5.9–6.9% by weight of zinc, 0.08–0.15% by weight of zirconium, a maximum of 0.12% by weight of silicon, a maximum of 0.15% by weight of iron, with the remainder being aluminum and other inevitable impurities.

For these types of aluminum alloys, adjustments have been proposed in both composition and processing variables to achieve improved strength and corrosion properties. U.S. Pat. No. 3,881,966 to Staley et al. discloses an aluminum based alloy containing zinc, copper and magnesium, together with zirconium, which exhibits very high strength when thermally treated to a condition having high resistance to stress corrosion cracking. A special aging treatment produces the optimum combination of strength and resistance to stress corrosion cracking.

U.S. Pat. No. 4,305,763 to Quist et al. discloses a 7000 series aluminum alloy characterized by high strength, high fatigue resistance and high fracture toughness. This combination of properties is achieved by controlling the chemical composition ranges of the alloying and trace elements, by heat treating the alloy to increase its strength to high levels, and by maintaining a substantially unrecrystallized microstructure.

U.S. Pat. No. 4,828,631 to Ponchel et al. is drawn to an improved high strength 7000 series aluminum alloy having specific and controlled amounts of alloying constituents that is produced using isothermal aging in a single step process. This alloy develops improved resistance to exfoliation by aging at a temperature from about 270° F. to about 285° F. for a period of from 6–30 hours or 6–60 hours.

However, a need still exists for AA 7000 series aluminum-based alloys which have superior exfoliation corrosion resistance and fracture toughness without sacrificing strength and/or elongation.

The present invention is directed to a method of producing an improved aluminum-based product having superior exfoliation resistance and fracture toughness. The method of the present invention includes providing an aluminum-based alloy having controlled alloying components as described herein which, when processed according to the method of the invention, has outstanding exfoliation corrosion resistance and fracture toughness.

SUMMARY OF THE INVENTION

It is accordingly one object of the present invention to provide a method for producing an aluminum-based alloy product having superior exfoliation resistance and fracture toughness.

It is a further object of the present invention to provide a method of producing an aluminum-based product which provides improved exfoliation resistance and fracture toughness without sacrificing strength and/or elongation.

It is another object of the present invention to provide a method of producing an aluminum-based product which includes precise control over the amounts of the alloying elements of copper, magnesium, and zinc to maintain a generally stoichiometric relationship between these elements for improved product properties.

It is a still further object of the present invention to provide a method of producing an aluminum-based product which combines a one- or two-step aging sequence with control over the stoichiometric relationship of the alloying elements of zinc, magnesium and copper.

Other objects and advantages of the present invention will become apparent as the description thereof proceeds.

In satisfaction of the foregoing objects and advantages, there is provided by the present invention a method of producing an aluminum alloy product having superior exfoliation resistance and fracture toughness which comprises an initial step of providing an aluminum-based alloy consisting essentially of about 5.5 to 10.0% by weight of zinc, about 1.75–2.6 4% by weight of magnesium, about 1.8–2.75% by weight of copper, a maximum of 0.15% by weight of iron, a maximum of 0.12%by weight of silicon, about 0.08–0.15% by weight of zirconium, one or more additional grain refining elements selected from chromium, manganese, titanium, boron, vanadium, and hafnium, the total of said additional grain refining elements being between 0.0% and about 0.5% by weight, with the balance aluminum and incidental impurities, wherein the amounts of zinc, copper and magnesium are stoichiometrically balanced in the alloy such that during an aging treatment of the alloy product, substantially all of the copper, magnesium and zinc form precipitates thereby producing an alloy product essentially free of excess copper and magnesium. The inventive method also includes working the alloy into a predetermined shape, heat treating the predetermined shape, quenching the heat treated shape, aging the heat treated shape for a period of time at an elevated temperature and recovering the aged alloy product.

In a preferred embodiment, the stoichiometric balancing of copper, zinc and magnesium may be performed according to a formula which permits determination of an amount of any excess copper or magnesium for a given alloy composition.

In another aspect of the present invention, the method of producing the aluminum-based alloy product may include a one- or a two-step aging sequence. Utilizing a two-step aging sequence provides an aluminum alloy product having both improved exfoliation corrosion resistance and fracture toughness. Using a single step aging sequence provides a product having an improved exfoliation resistance compared to prior art AA 7000 series alloys. A product of the inventive method is also disclosed.

BRIEF DESCRIPTION OF DRAWINGS

Reference is now made to the Drawings accompanying the application wherein.

DESCRIPTION OF THE PREFERRED EMBODIMENTS

Figure 1:
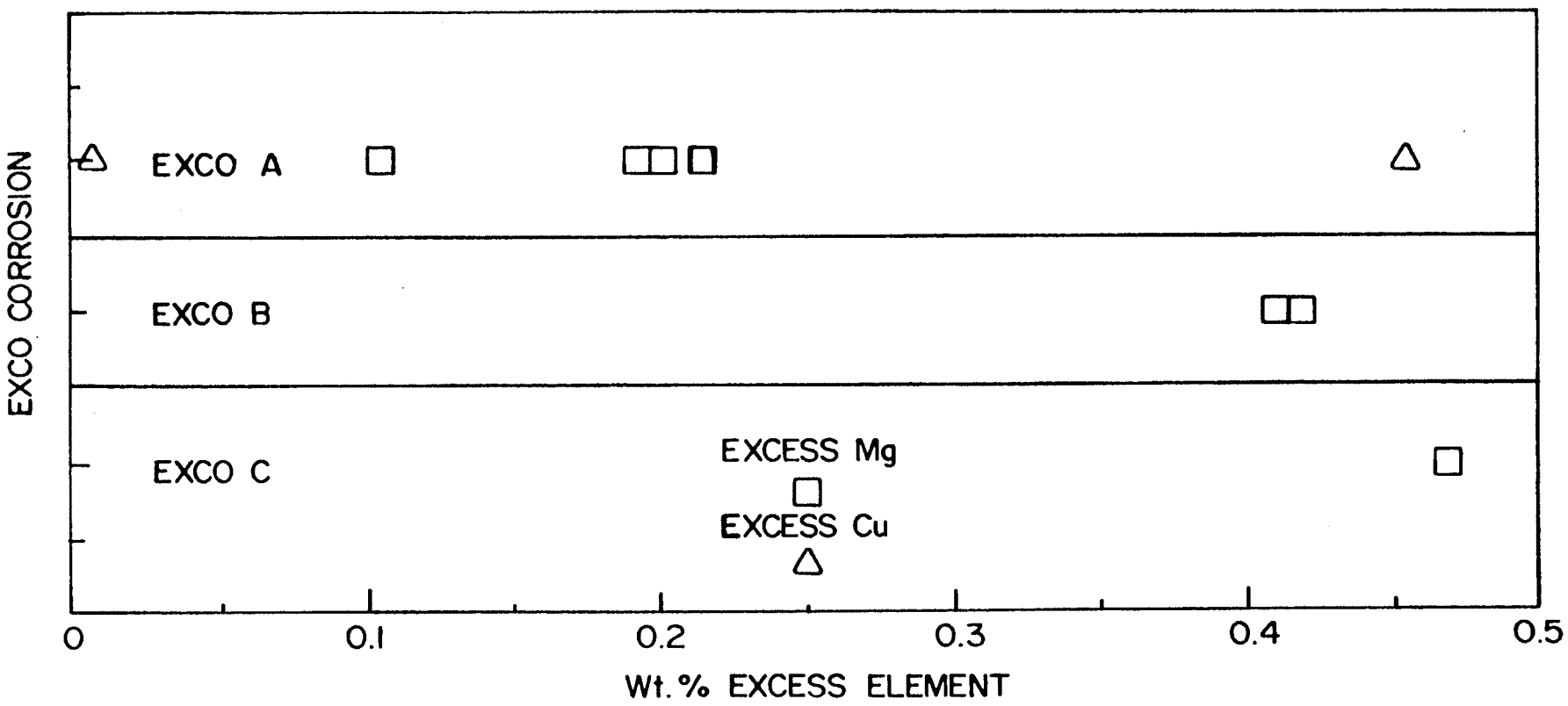
FIG. 1 illustrates the relationship between exfoliation corrosion resistance and weight percentage excess element for a two-step aging process.

The present invention relates to a method of producing an aluminum alloy product having improved exfoliation resistance and fracture toughness properties. More particularly, the invention is directed to producing a AA 7000 series aluminum alloy primarily for aerospace and aircraft industry application.

In one aspect of the inventive method, an aluminum-zinc-magnesium-copper alloy is provided having a stoichiometric balance between the elements of zinc, magnesium and copper. It has been discovered that controlling the elements of zinc, copper and magnesium in stoichiometric amounts results in a generally complete precipitation of intermetallic compounds during the aging of the alloy product, thereby substantially eliminating the presence of excess copper or magnesium in the alloy product matrix. Thus, for a given amount of zinc, magnesium and copper for these types of alloys, a determination can be made as to the expected excess of magnesium or copper once precipitation as a result of aging essentially has been completed. Based upon this determination, one or more of the alloying elements may be adjusted to maintain an alloy product generally free of excess magnesium or copper. Alternatively, an alloy composition can be formulated based upon a first alloying element with the remaining alloying elements being selected to maintain the proper stoichiometric balance.

The method of producing an aluminum-based alloy product having superior exfoliation resistance and fracture toughness includes the steps of providing an aluminum-based alloy consisting essentially of about 5.5 to 10.0% by weight of zinc, about 1.75 to 2.6% by weight of magnesium, about 1.8 to 2.75% by weight of copper, a maximum of 0.15% by weight of iron, a maximum of 0.12% by weight of silicon, about 0.08 to 0.15% by weight of zirconium, as well as, in some cases, one or more additional grain refining elements selected from chromium, manganese, titanium, boron, vanadium, and hafnium, the total not to exceed about 0.5%, with the balance aluminum and incidental impurities. The aluminum-based alloy includes amounts of zinc, magnesium and copper which are stoichiometrically balanced in the alloy such that during an aging treatment of the alloy product, substantially all of the copper, magnesium and zinc form precipitates, thereby producing an alloy product essentially free of excess copper and/or magnesium.

Once the alloy composition is provided, the alloy is worked into a predetermined shape, heat treated, quenched and aged for a period of time at an elevated temperature. The aged alloy product is then recovered for further use.

The amounts of zinc, magnesium and copper may be stoichiometrically balanced according to the formula defined as:

$$A = 0.19\ (Z);$$

$$B = 0.37\ (C);$$

$$T = A + B;\ \text{and}$$

$$\text{if } T < X, \text{ then } X - T = \text{excess Mg (wt. \%); or}$$

$$\text{if } T = X, \text{ the excess Mg and Cu (wt. \%)} = 0; \text{ or}$$

$$\text{if } T > X, \text{ then } (C - (M - A)/0.37) = \text{excess Cu (wt. \%)}$$

wherein x and M equal the amount of Mg (wt. %) available, Z equals the amount of zinc (wt. %), and C equals the amount of Cu (wt. %) in said alloy composition.

For example, for an alloy having 2.26 wt. % Mg, 6.43 wt. % Zn and 1.0 wt. % Cu, A=1.22, B=0.37 and T=1.59. Since T<X, the excess Mg=0.67.

In a preferred embodiment of the inventive method, the aluminum-based alloy provided for producing an alloy product consists essentially of about 5.8–7.1% by weight of zinc, about 1.8–2.5% by weight of magnesium and about 2.1–2.7% by weight of copper. Again, the amounts of zinc, magnesium and copper are stoichiometrically balanced as described hereinabove.

In a more preferred embodiment of the present invention, the aluminum-based alloy provided for producing the alloy product consists essentially of about 6.6–6.8% by weight of zinc, about 2.05–2.25% by weight of magnesium and about 2.1–2.3% by weight of copper with the balance aluminum and other elements described above.

In a most preferred embodiment of the present invention, the aluminum-based alloy provided for producing the inventive alloy product consists essentially of about 6.56% by weight of zinc, 1.98% by weight of magnesium and 1.99% by weight of copper, an effective amount of zirconium, with the balance aluminum and incidental impurities. Alternatively, the aluminum-based alloy may consist essentially of about 6.65% by weight of zinc, about 2.08% by weight of magnesium and about 2.21% by weight of copper with the balance aluminum.

Experimental and tonnage-based trials, as will be described hereinafter, demonstrate that maintaining the stoichiometric balance between zinc, magnesium and copper produces an aluminum alloy product having improved exfoliation resistance and fracture toughness.

In another aspect of the present invention, the method of producing an aluminum-based alloy product uses particular aging steps which, when practiced on an alloy composition having the stoichiometric balance as described above, provides an improved product that shows improvements in exfoliation resistance and fracture toughness, in one embodiment, and improvements in exfoliation resistance, without sacrificing mechanical properties, in another embodiment. One mode of aging used in the inventive method includes a two-step aging sequence wherein the alloy is first aged at 250° F. for about 9 hours followed by a second aging step at about 315° F. for about 10 to 16 hours followed by air cooling. In a second mode of aging, the aluminum-based alloy product is aged in a single step in a temperature range between about 240° F. and 290° F. for appropriate times, such as for about 16 hours at 260° F. to 270° F., followed by air cooling.

Maintenance of the stoichiometric balance of zinc, magnesium and copper in the alloy compositions used in the inventive method is based upon a two-part reaction scheme which is designed to minimize or eliminate any excess or surplus of either magnesium or copper in the alloy product following precipitation.

The two-part reaction scheme is based upon the assumption that the alloying elements of zinc, magnesium and copper will be utilized in the formation of transition phases which would eventually transform to $MgZn_2$ and $Al_2CuMg$ upon reaching thermodynamic equilibrium. These precipitated phases require distinct ratios between the alloying elements. Therefore, if an alloy is produced with the desired proportions of alloying elements, there will be no significant excess of any of the alloying elements present when the precipitation process proceeds to completion. As will be demonstrated hereinafter, alloys which adhere closest to this compositional rule exhibit superior fracture toughness compared to other alloys. It has also been demonstrated that compositions which are generally essentially free of excess magnesium and excess copper show superior exfoliation resistance compared to other alloys. Therefore, maintaining the stoichiometric balance between these elements during the inventive method of producing an aluminum-based alloy product produces an alloy product having improved fracture toughness and/or exfoliation resistance over prior art alloy products.

The two-part reaction scheme assumes that during aging, $MgZn_2$ will be the first precipitate phase to form. During this stage, all zinc will be reacted with some magnesium (in the ratio of about 0.19 wt. % magnesium to 1.0 wt. % zinc) to form $MgZn_2$. After formation of $MgZn_2$, it is assumed that the remaining magnesium will combine with copper (in the ratio of about 0.37 wt. % magnesium to 1.0 wt. % copper) to form $Al_2CuMg$. The amount of excess copper or magnesium which remains following these reactions can then be calculated.

The following shows a sample calculation for an exemplary alloy containing 6.43% zinc, 2.26% magnesium and 2.22% copper, all percentages being in weight.

Step 1: Form $MgZn_2$ $$6.43\%\ Zn \times 0.19 = 1.22\%\ Mg \text{ used in forming } MgZn_2$$

Step 2: Form $Al_2CuMg$ $$2.22\%\ Cu \times 0.37 = 0.82\%\ Mg \text{ used in combining with all Cu}$$

Step 3: Determine how much Mg was used in both reactions $$1.22\%\ Mg + 0.82\%\ Mg = 2.04\%\ Mg$$

Step 4: Determine the excess element $$2.04\%\ Mg < 2.26\%\ Mg \text{ in the alloy, therefore, there is an excess of } 0.22\%\ Mg.$$

Again, it should be noted that, based upon the relative amounts of magnesium, zinc and copper for these types of AA 7000 series aluminum alloys, and the ratios, as described above, between magnesium and zinc and magnesium and copper, an excess of magnesium results after the formation of $MgZn_2$, the excess magnesium combining with copper and aluminum to form $Al_2CuMg$. Therefore, the amount of magnesium remaining after being combined with zinc determines whether the excess element is either copper or magnesium. For example, if there is insufficient magnesium to react with the copper to form $Al_2CuMg$, excess copper will exist in the alloy. Alternatively, if there is sufficient magnesium to combine with the copper to form $Al_2CuMg$, any magnesium over that amount will be left as an excess element.

The model described above for relating the stoichiometric amounts of magnesium, copper and zinc is believed to be close to being accurate. Small deviations from the model include:

(1) a small amount of copper may be substituted in the $MgZn_2$ phase;

(2) there will be some solubility of zinc, magnesium and copper in the aluminum matrix at the aging temperature (although it is expected that the solubility will be less than 0.1% as seen by combining ternary phase diagrams into a quaternary diagram);

(3) alloys will not be at complete thermodynamic equilibrium and, therefore, precipitation will not be fully complete; and (4) silicon as an impurity will decrease the magnesium content slightly due to the formation of $Mg_2Si$. However, it is anticipated that the above deviations are not significant with respect to the overall conceptual model as to the stoichiometric balance between zinc, magnesium and copper and therefore, should not effect the relationships therebetween.

Generally, the alloy products of the present invention are wrought alloys and are prepared, in part, in accordance with conventional methods known to the art. Preferably, the alloying components as defined above are mixed and formed into a melt to alloy the components. The alloy is then provided in the form of a billet or ingot that is subjected to conventional thermal processing. The alloy is then mechanically worked by means known to the art such as rolling, forging, stamping or extruding to form a predetermined shape. After working, the alloys should be solution heat treated at an elevated temperature followed by quenching and then aging. In a preferred procedure, the alloys are solution heat treated at about 880° F. followed by a water spray quench.

It should be understood that the casting, working, solution heat treating and quenching steps of the inventive method are well recognized in the art. As such, further details as to these specific processing steps are not included.

The following experimental trials are presented to illustrate the invention which is not to be considered as limited thereto. In the examples and throughout the specification, parts are by weight unless otherwise indicated. The experimental trials are also based on tonnage quantities of metal rather than laboratory scale amounts.

Experimental Trial I

With reference to Table I, 10 different compositions are shown which were selected to demonstrate the effect of stoichiometric balance and aging conditions on properties of exfoliation resistance and fracture toughness. The designation L, M or H refers to the relative amounts of zinc, magnesium and copper when compared to the Aluminum Association limits shown at the bottom of the table. For example, lot number 19030-A having a LLL designation has percentages of zinc, magnesium and copper near the lower limits of the AA range. The AA limits noted on the bottom of Table I are the overall ranges specified by the Aluminum Association for AA 7150 alloy compositions.

Table II shows the weight percent excess of either copper or magnesium for each of the alloy compositions used in the Experimental Trial I and noted in Table I. In particular, Lot Number 19030-F showing a high level of zinc with low levels of copper and magnesium with respect to the standard AA 7150 limits, shows an alloy composition essentially free of either magnesium or copper, i.e., less than 0.01 weight percent excess copper.

Table III shows exfoliation resistance test results and fracture toughness test results for each of the lot numbers depicted in Table I. It should be understood that the exfoliation resistance results are obtained according to the test procedures defined in ASTM G34-79. Since this test procedure is well recognized in the art, further discussion is not included.

Figure 2:
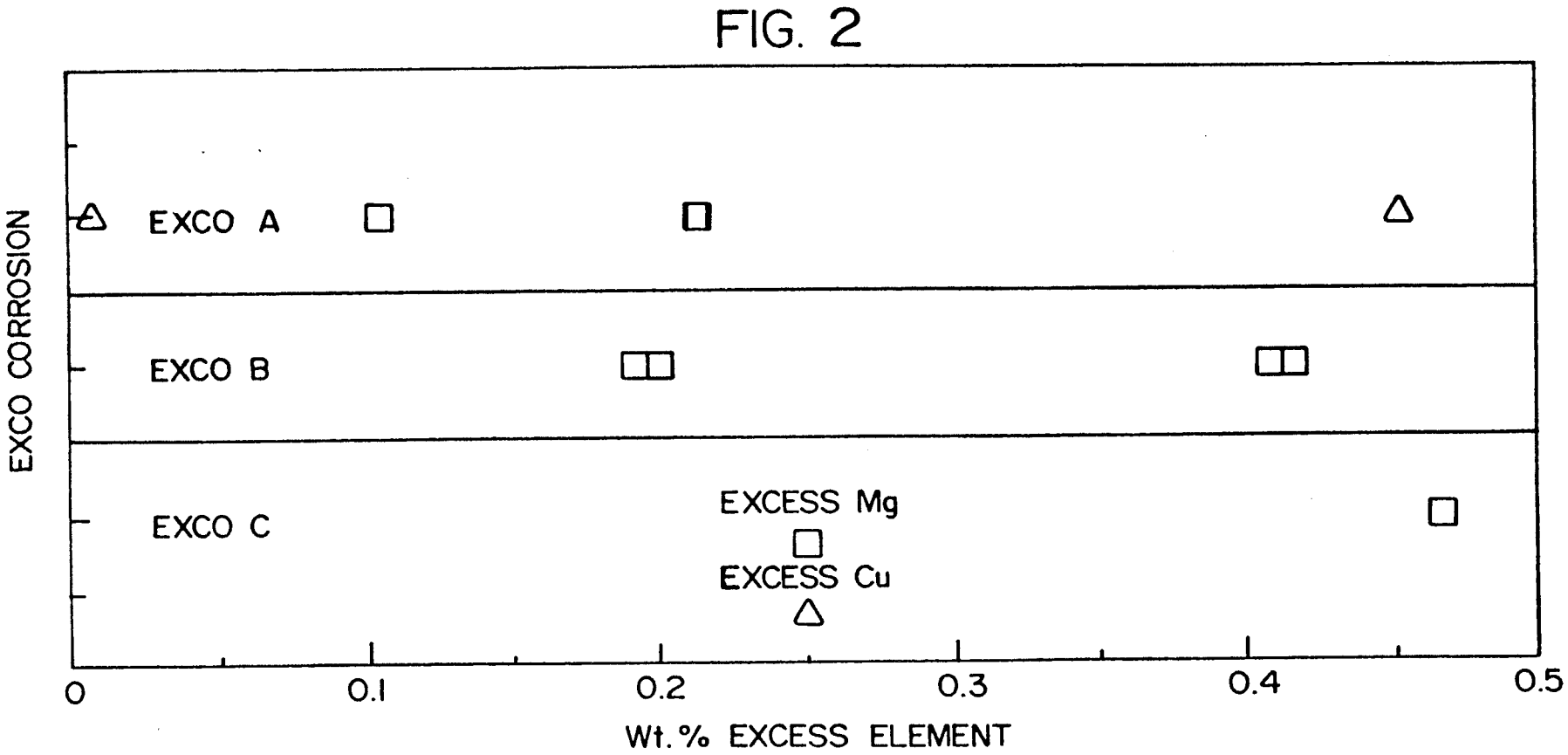
FIG. 2 shows a graph similar to FIG. 1 for a slightly overaged condition.
Figure 3:
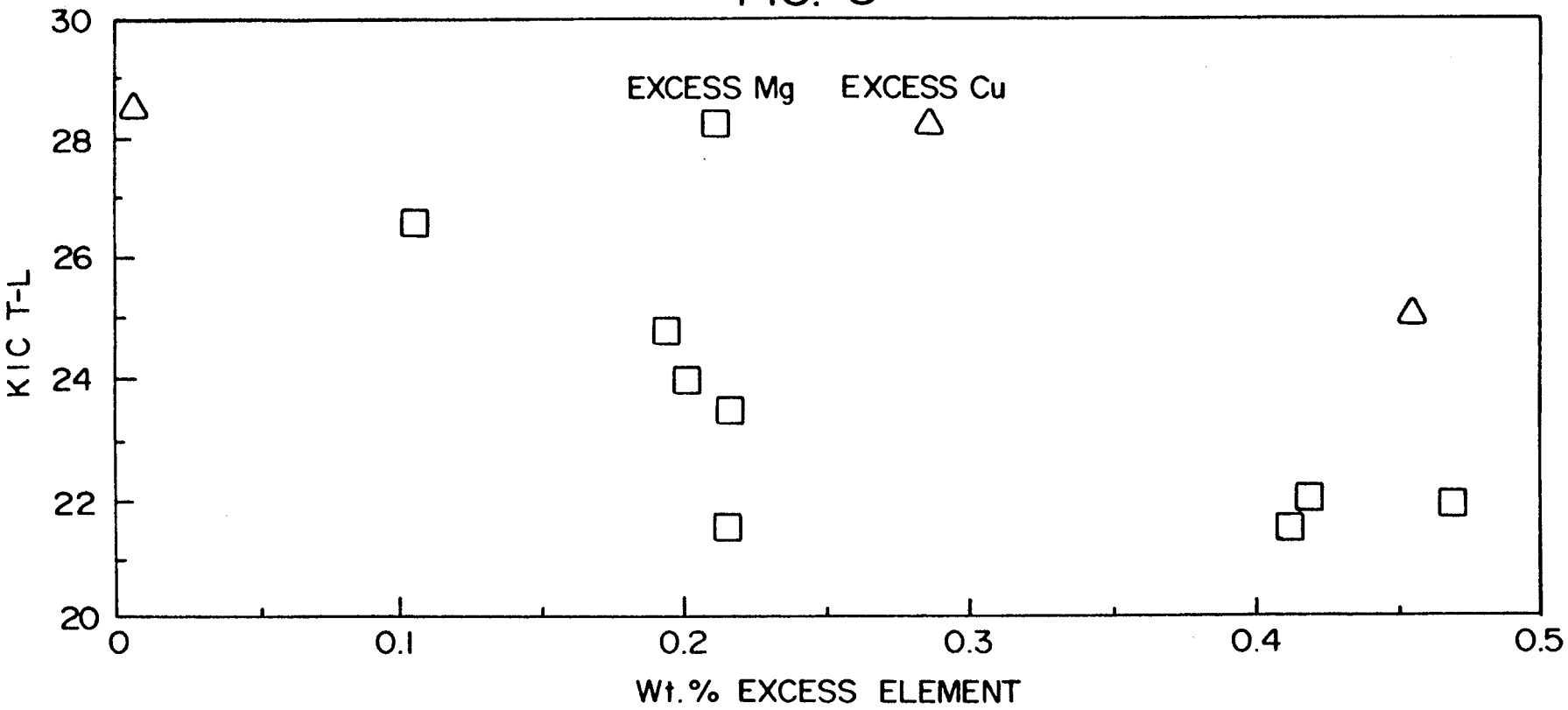
FIG. 3 shows a graph relating fracture toughness and weight percent excess element for a two-step aging sequence.
Figure 4:
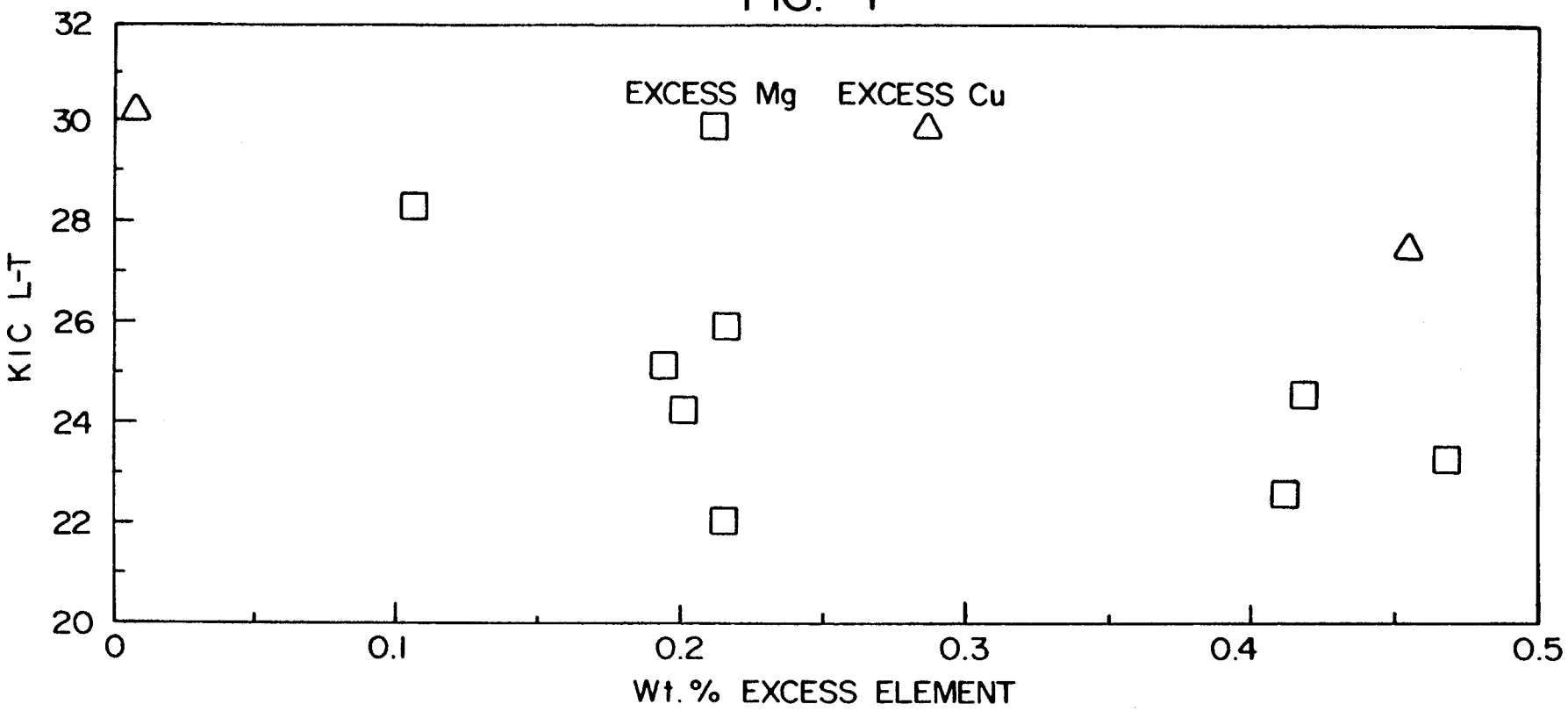
FIG. 4 shows a graph similar to the graph depicted in FIG. 3 wherein fracture toughness is determined in a different direction.

FIGS. 1–4 graphically illustrate the effects of excess copper or magnesium with respect to exfoliation resistance and fracture toughness. Each of FIGS. 1 and 2 relate the specific weight percent excess elements shown in Table II for varying levels of exfoliation resistance. FIGS. 3 and 4 relate weight percent excess element and fracture toughness values. It should be noted that the overaged condition specified in FIGS. 1, 3 and 4 refers to extended aging at the 315° F. temperature. In contrast, FIG. 2 shows the results for a slightly overaged condition wherein the second step of the aging process is about 10 hours at 315° F.

As evidenced by FIGS. 1 and 2, there is excellent correlation between the resistance to exfoliation corrosion and the type and quantity of excess element. In both the slightly overaged and overaged conditions, the alloy composition most closely approximating a stoichiometric balance, that is, essentially free of excess copper or magnesium, i.e. lot 19030-F, shows superior exfoliation resistance. In contrast, alloy compositions having a significant excess of magnesium, especially in the slightly overaged, near peak strength condition, exhibit reduced exfoliation resistance. It should also be noted that excess amounts of copper are not as detrimental to exfoliation resistance as excess magnesium.

There is also the correlation between fracture toughness and the type and quantity of the excess elements, as indicated in FIGS. 3 and 4. Again, Lot Number 19030-F exhibits high fracture toughness as compared with alloy compositions having large amounts of excess magnesium or copper. This lot, when compared with the other lots, also shows that, while it is preferable to have a stoichiometric balance, a slight excess of copper is preferred to a slight excess of magnesium.

TABLE I

| Lot Number | Designation | Zn | Mg | Cu | Zr | Fe | Si |
|---|---|---|---|---|---|---|---|
| 19030-A | LLL | 6.09 | 2.07 | 2.18 | .10 | .048 | .05 |
| 19030-B | MMM | 6.43 | 2.26 | 2.22 | .10 | .046 | .05 |
| 19030-C | MMM | 6.38 | 2.25 | 2.26 | .10 | .062 | .05 |
| 19030-D | HLH | 6.69 | 2.02 | 2.48 | .10 | .047 | .04 |
| 19030-E | MMM | 6.33 | 2.23 | 2.25 | .10 | .062 | .05 |
| 19030-F | HLL | 6.56 | 1.98 | 1.99 | .11 | .054 | .05 |
| 19030-G | HHL | 6.55 | 2.40 | 1.99 | .10 | .047 | .05 |
| 19030-H | LHL | 6.01 | 2.41 | 2.16 | .10 | .051 | .05 |
| 19030-I | HHH | 6.77 | 2.39 | 2.40 | .10 | .05 | .05 |
| 19030-J | LHH | 6.08 | 2.50 | 2.52 | .11 | .06 | .05 |
| | A.A. Limits | 5.9–6.9 | 2.0–2.7 | 1.9–2.5 | 0.08–0.15 | 0.15 | 0.12 |

TABLE II

| Lot Number | Designation | Excess Element | Wt. % Excess |
|---|---|---|---|
| 19030-A | LLL | Mg | 0.11 |
| 19030-B | MMM | Mg | 0.22 |
| 19030-C | MMM | Mg | 0.20 |
| 19030-D | HLH | Cu | 0.46 |
| 19030-E | MMM | Mg | 0.19 |
| 19030-F | HLL | Cu | <0.01 |
| 19030-G | HHL | Mg | 0.42 |
| 19030-H | LHL | Mg | 0.47 |
| 19030-I | HHH | Mg | 0.22 |
| 19030-J | LHH | Mg | 0.41 |

TABLE III

| Lot Number | Exco Slightly Overaged[1] | Exco Overaged[2] | $K_{1C}$ L-T[2] | $K_{1C}$ T-L[2] |
|---|---|---|---|---|
| 19030-A | A | A | 28.3 | 26.6 |
| 19030-B | A | A | 26.0 | 23.5 |
| 19030-C | B | A | 24.3 | 24.0 |
| 19030-D | A | A | 27.6 | 25.1 |
| 19030-E | B | A | 25.2 | 24.8 |
| 19030-F | A | A | 30.2 | 28.5 |
| 19030-G | B | B | 24.7 | 22.1 |
| 19030-H | C | C | 23.4 | 22.0 |
| 19030-I | A | A | 22.1 | 21.6 |

TABLE III-continued

| Lot Number | Exco Slightly Overaged[1] | Exco Overaged[2] | $K_{1C}$ L-T[2] | $K_{1C}$ T-L[2] |
|---|---|---|---|---|
| 19030-J | B | B | 22.7 | 21.6 |

[1]Aged 9 hours at 250° F. + 10 hours at 315° F.
[2]Aged 9 hours at 250° F. + 16 hours at 315° F.

The correlation of the stoichiometric balance model, as evidenced by the data illustrated in Table III and FIGS. 1–4, is significant. Accordingly, FIGS. 5 and 6 were created to show specific compositions within the general compositional range for AA 7150 type alloys wherein no excess elements are present. These graphs demonstrate that for a specific amount of zinc, there are several different amounts of copper and magnesium which will combine such that no excess elements are present following precipitation. These compositions fall on a line for a given amount of zinc and, according to the model, will have the highest toughness and best exfoliation resistance. Compositions above the line have excess magnesium and compositions below the line have excess copper.

Figure 5:
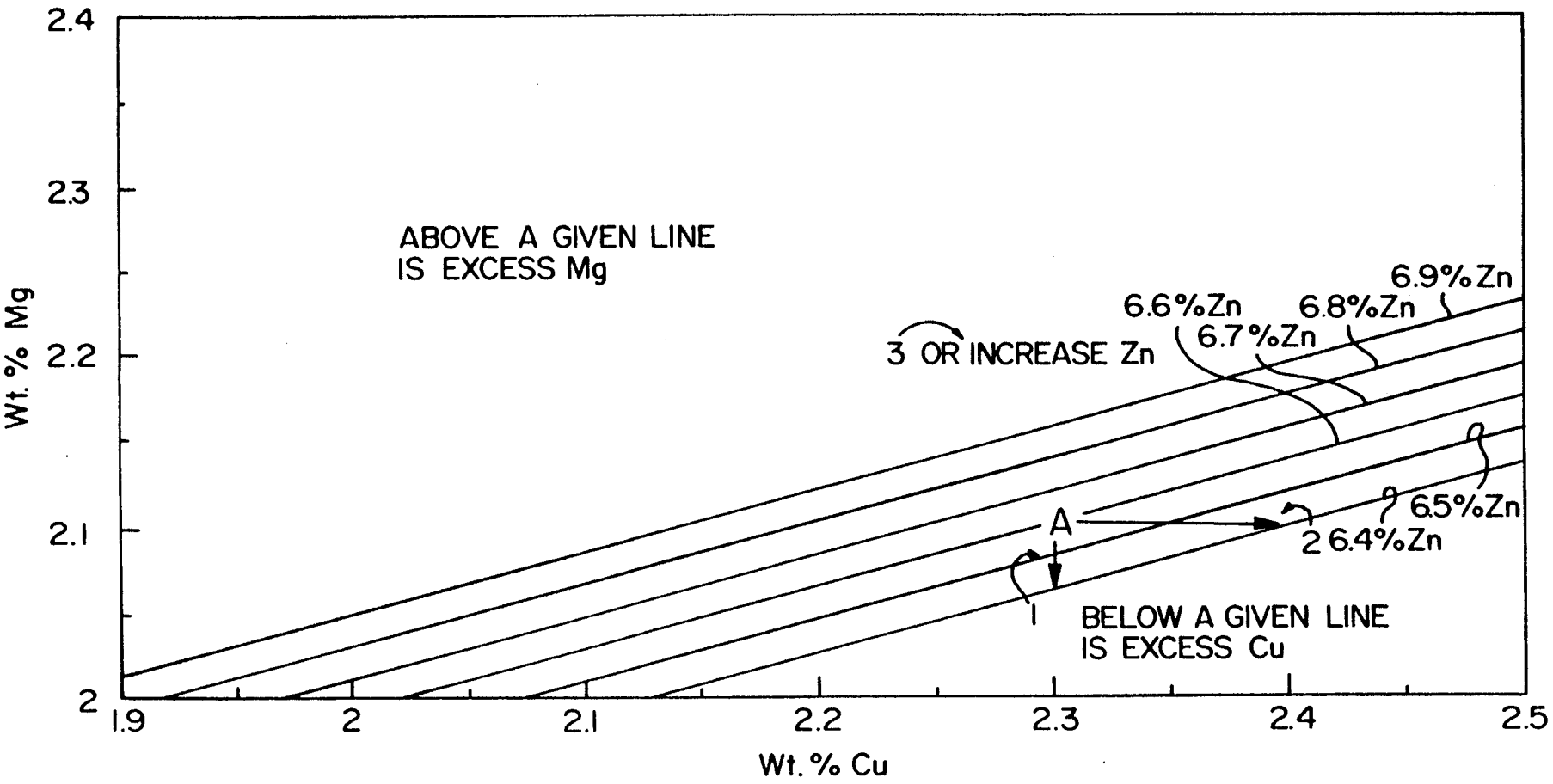
FIGS. 5 and 6 show graphs relating weight percentages of magnesium and copper with respect to weight percentage of zinc.
Figure 6:
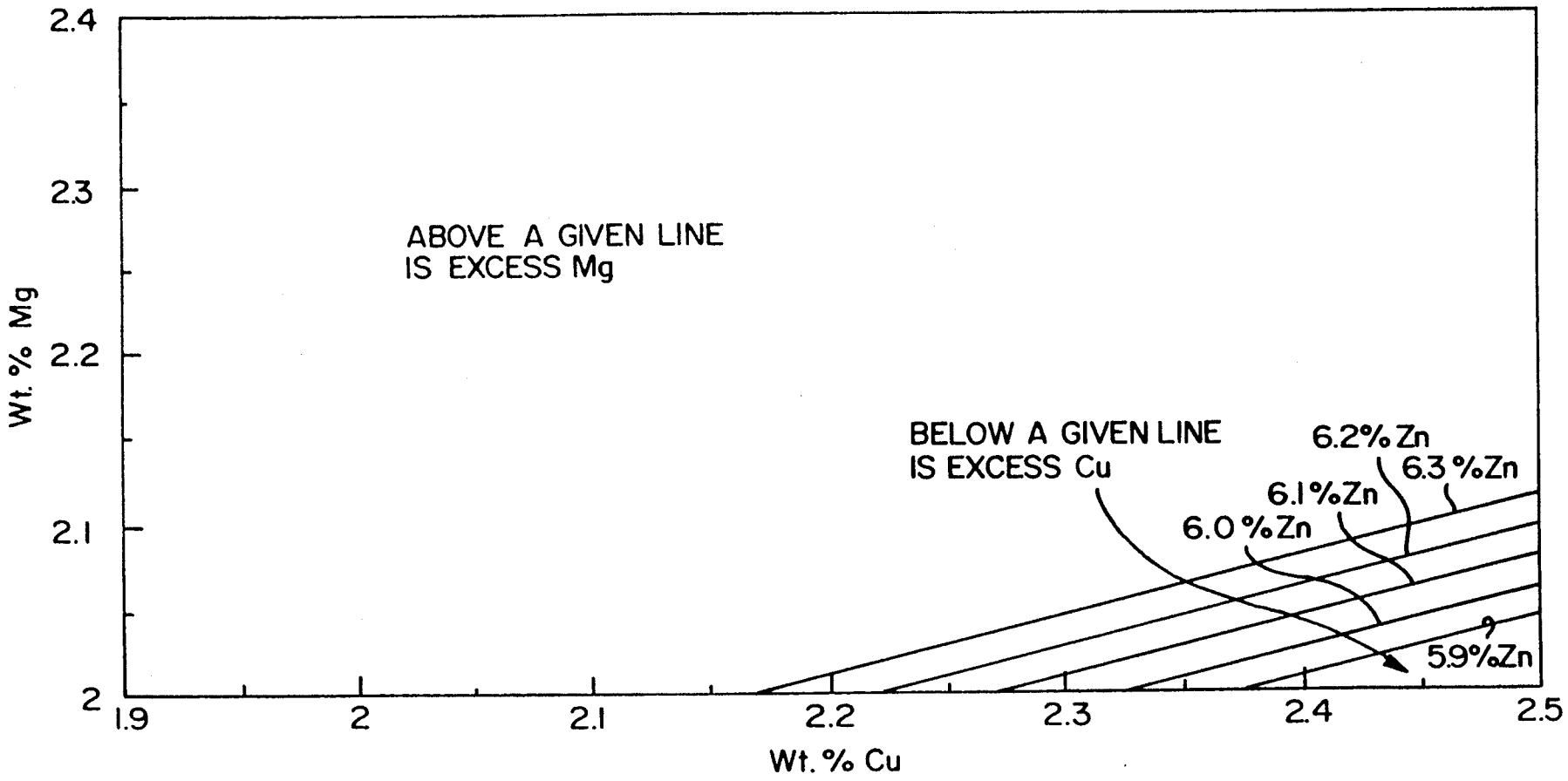

The following example shows how to use the diagrams in FIGS. 5 and 6 to determine optimum compositions, i.e. those with an optimum combination of toughness and exfoliation resistance. With reference now to FIG. 5, assume a alloy composition having 6.4% zinc, 2.1% magnesium and 2.3% copper. The intersection of the copper and magnesium is designated by the letter A. However, letter A falls above the 6.4% zinc line and, therefore, has an excess of magnesium. From the results discussed above, this composition probably has only fair exfoliation resistance and moderate toughness. In order to improve the exfoliation resistance and toughness properties, the alloy composition may be adjusted as follows:

(1) lower the magnesium as indicated by the arrow 1 to be on the 6.4% zinc line;
(2) raise the copper as indicated by the arrow 2 to be on the 6.4% zinc line; or
(3) raise the zinc amount to 6.6% as indicated by arrow 3 to place the alloy composition on a new stoichiometric balance line, i.e. the 6.6% zinc line.

By stoichiometrically balancing the alloy composition to correspond to one of the lines in FIG. 5, an alloy product is provided having both improved exfoliation resistance and fracture toughness.

FIG. 6 shows the stoichiometric balance lines for lower amounts of zinc, e.g. about 5.9% zinc to 6.3% zinc.

Experimental Trial II

Another experimental trial was performed on a tonnage basis to further investigate the unexpected improvements associated with the stoichiometric balancing of zinc, magnesium and copper in aluminum alloys when practiced according to the inventive method. In these experimental trials, a single step aging process was utilized in combination with maintenance of the stoichiometric balance of zinc, magnesium and copper as described above.

Table IV shows a chemical analysis of the range of copper, magnesium and zinc for 12 lots of the second experimental trial.

Table V shows the relationship for each composition of the 12 lots and a weight percentage of an excess alloying element as determined according to the formula stated above. It can be clearly seen that these 12 lots have a low amount of excess element present, and consequently deviate little from the stoichiometric balance model presented above.

It should be understood that during the second experimental trial, a single step aging process was utilized during processing of the aluminum alloy product, i.e. about 16 hours at 260° F. to 270° F. followed by air cooling. Solutionization was performed at about 880° F. followed by a water spray quench. The single step aging process was used when producing the alloy composition maintaining stoichiometric balance and a standard product indicative of a prior art alloy composition.

The ranges for the standard product include 6.2–6.6% zinc, 2.0–2.4% magnesium and 1.9–2.3% copper. These standard limits are to be compared with the alloy compositions described in Table IV. The generalized range for the alloy compositions listed in Table IV include about 6.6–6.8% zinc, about 2.05–2.2% magnesium and 2.1–2.3% copper. In comparing the limits used in practicing the inventive method with the standard limits, the amount of zinc and copper are increased and the magnesium amount is decreased. Specifically, the weight percentage of zinc is increased about 0.3%, with the copper being increased about 0.1% with a decrease of about 0.1% in magnesium.

Figure 7:
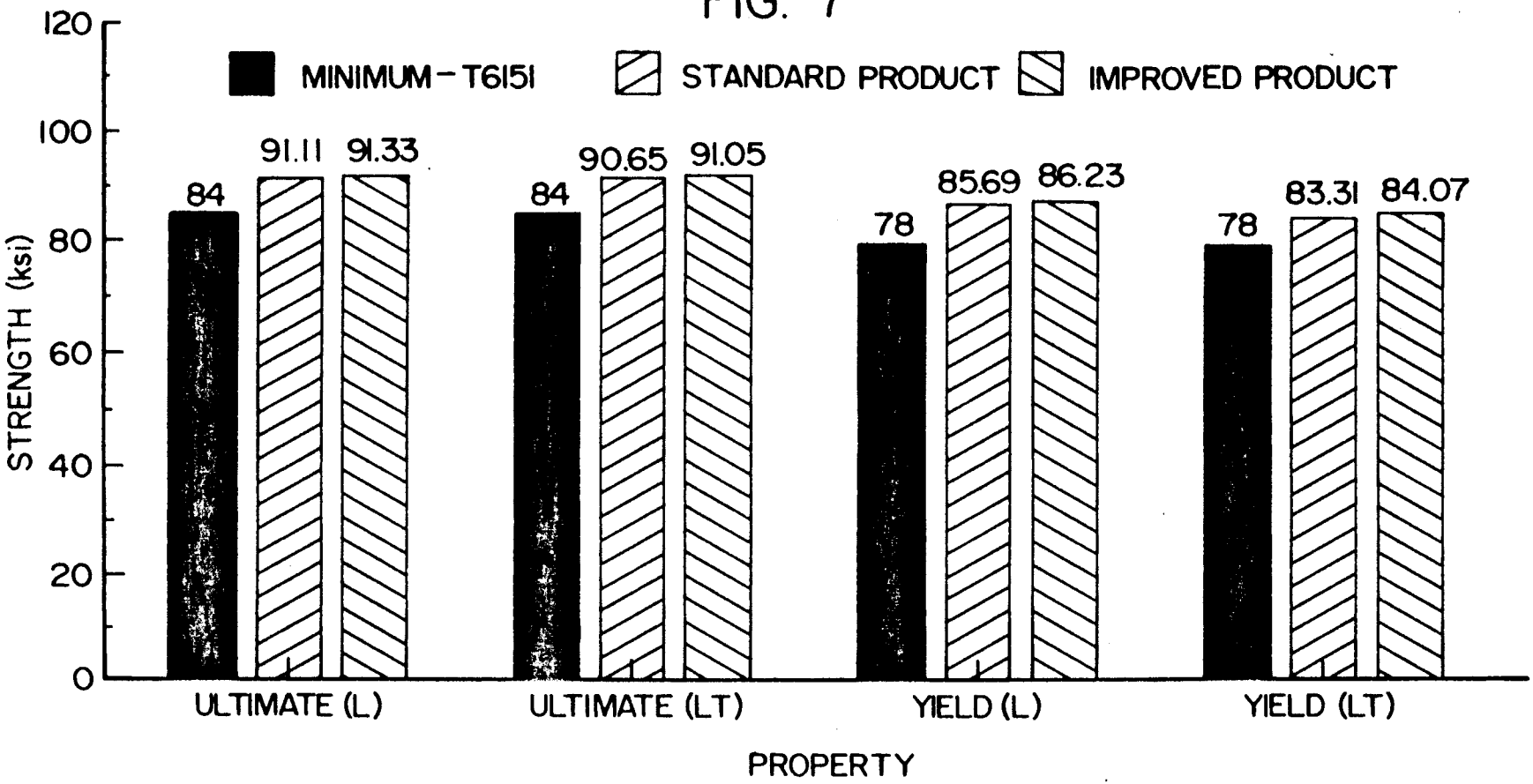
FIG. 7 shows a bar graph comparing tensile properties for a prior art product and the improved product obtained according to the inventive method.
Figure 8:
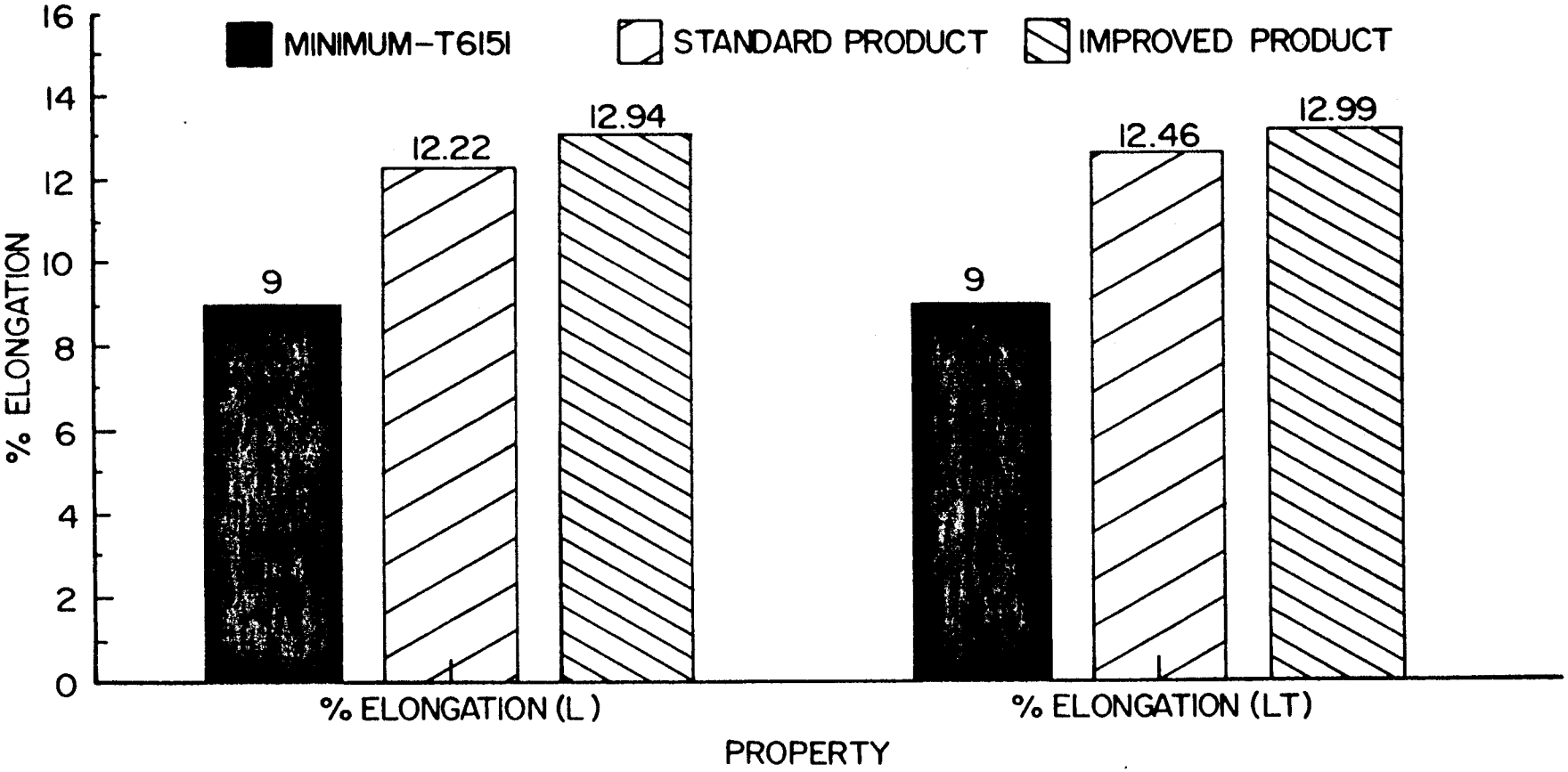
FIG. 8 shows a graph similar to FIG. 7 comparing elongation between the product produced according to the inventive method when compared to a prior art product.
Figure 9:
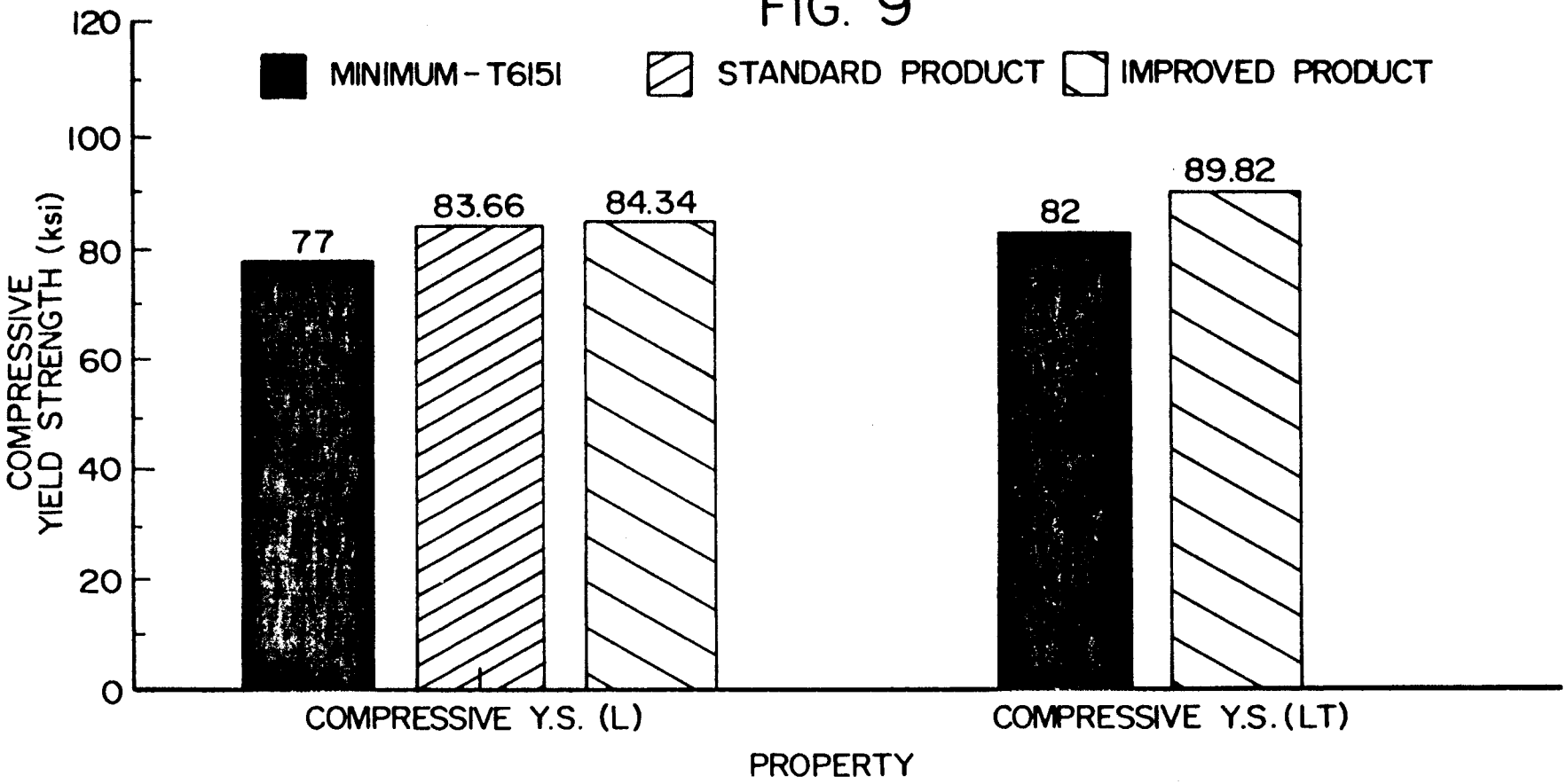
FIG. 9 shows a bar graph comparing compressive strength for a prior art product and the improved product obtained according to the inventive method.

FIGS. 7–9 show a comparison of tensile ultimate strength, tensile yield strength, elongation and compressive yield strength between the standard product as described above, the improved product practiced according to the inventive method and the minimum acceptable levels for each particular property. As is evident from each of FIGS. 7, 8 and 9, the improved alloy product provides levels of mechanical properties that are equivalent to the standard product. It should be understood that the standard product test results were based upon different numbers of lots due to the availability of certain lots for testing.

Figure 10:
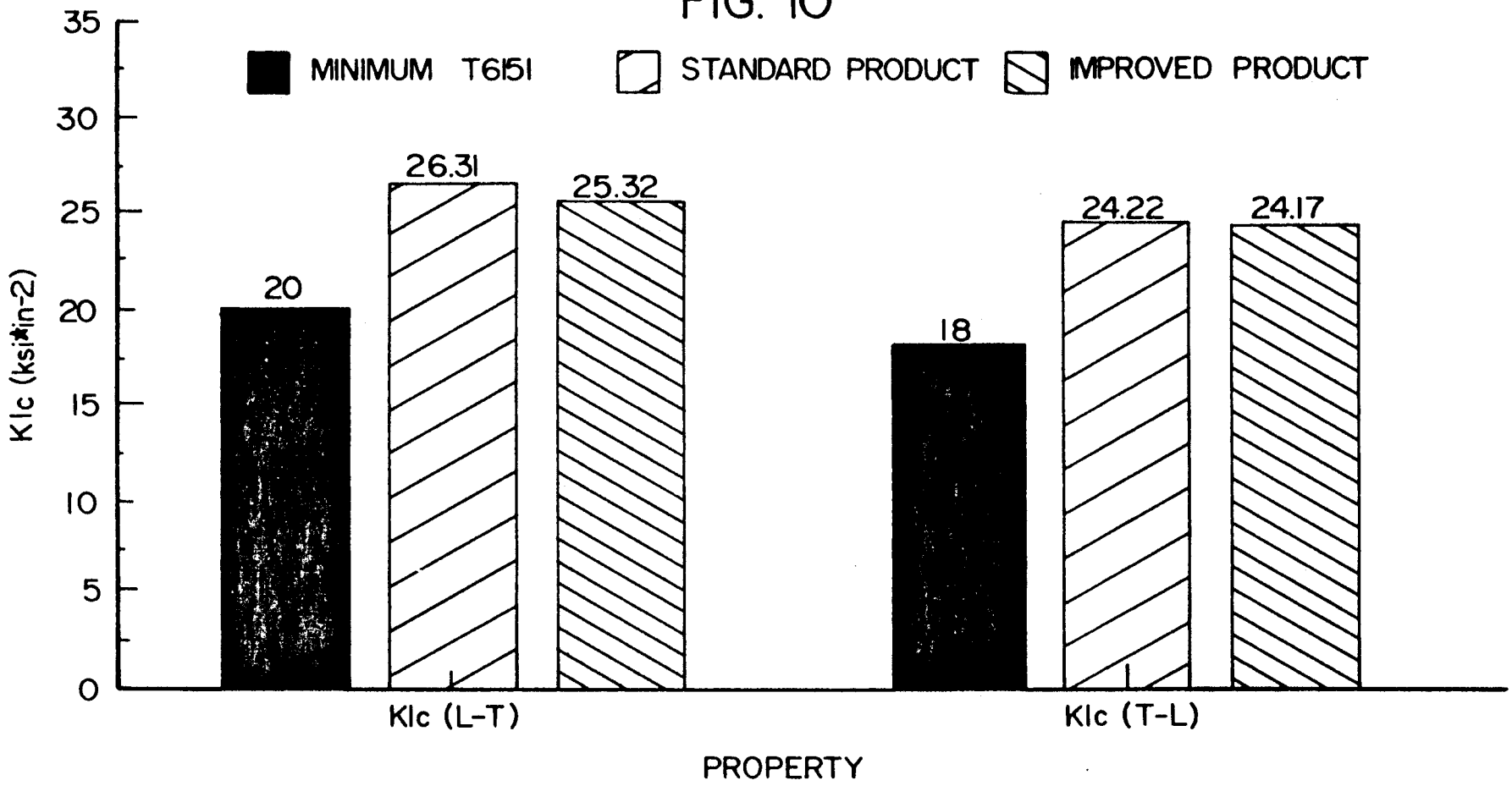
FIG. 10 shows a comparison of fracture toughness between the alloy product of the inventive method and a standard product.
Figure 11:
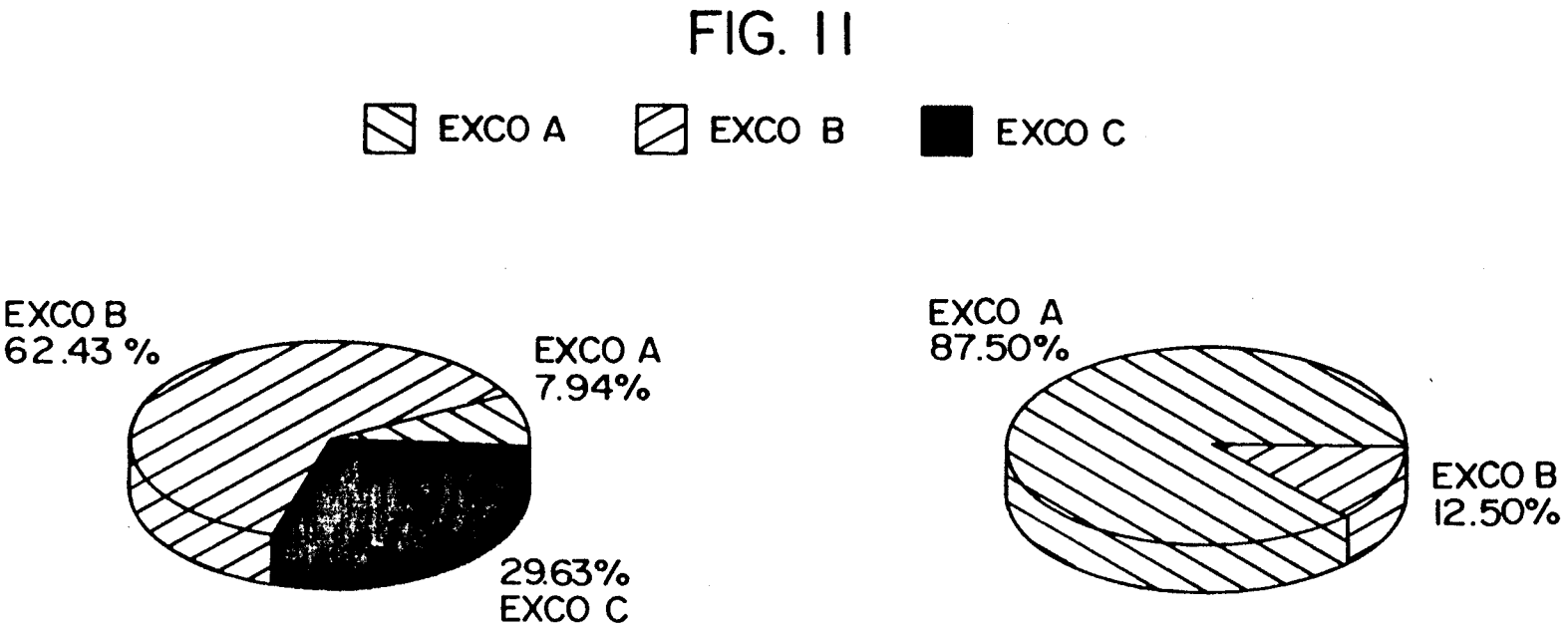
FIG. 11 shows a comparison between the inventive improved product and a prior art product with respect to exfoliation corrosion resistance.

FIGS. 10 and 11 illustrate fracture toughness and exfoliation resistance comparisons, respectively, for the standard product and the improved product obtained by the inventive method. As illustrated, the improved product shows a fracture toughness equivalent to the standard product but with an increased and unexpected improvement in exfoliation corrosion resistance. With particular reference to FIG. 11, approximately 88% of the improved product exhibits an EXCO A exfoliation corrosion rating whereas the standard product only exhibits approximately 8% EXCO A rating. As such, the alloy product made by the inventive method provides acceptable levels of mechanical properties with an unexpected improvement in exfoliation corrosion resistance.

TABLE IV

| | ICP ANALYSIS | | |
|---|---|---|---|
| Plate Sections | % Cu | % Mg | % Zn |
| Lot | | | |
| 910X057 A | 2.18 | 2.06 | 6.81 |
| 910X057 B | 2.21 | 2.08 | 6.68 |
| 910X057 C | 2.13 | 2.08 | 6.75 |
| 910X057 D | 2.20 | 2.08 | 6.71 |
| 910X057 E | 2.21 | 2.06 | 6.58 |
| 910X057 F | 2.21 | 2.08 | 6.65 |
| Lot | | | |
| 910X074 A | 2.18 | 2.14 | 6.88 |
| 910X074 B | 2.13 | 2.11 | 6.78 |
| 910X074 C | 2.18 | 2.09 | 6.71 |
| 910X074 D | 2.25 | 2.10 | 6.75 |
| 910X074 E | 2.26 | 2.09 | 6.69 |

TABLE IV-continued

| Plate Sections | ICP ANALYSIS % Cu | % Mg | % Zn |
|---|---|---|---|
| 910X074 F | 2.30 | 2.13 | 6.68 |

TABLE V

| Plate Sections | Enough Mg for Complete use of Zn as $MgZn_2$? | Excess Element Following $Al_2CuMg$ Formation | Wt. % Excess |
|---|---|---|---|
| Lot | | | |
| 910X057 A | YES | Cu | 0.11 |
| 910X057 B | YES | Cu | 0.02 |
| 910X057 C | YES | Mg | 0.01 |
| 910X057 D | YES | Cu | 0.02 |
| 910X057 E | YES | Cu | 0.02 |
| 910X057 F | YES | Cu | <0.01 |
| Lot | | | |
| 910X074 A | YES | Mg | 0.03 |
| 910X074 B | YES | Mg | 0.03 |
| 910X074 C | YES | Mg | 0.01 |
| 910X074 D | YES | Cu | 0.04 |
| 910X074 E | YES | Cu | 0.05 |
| 910X074 F | YES | Mg | 0.01 |

Moreover, the alloy product produced by the inventive method in accordance with the aging conditions set forth in the second experimental trial possesses significant advantages over other prior art alloys having similar mechanical and corrosion properties. Alternatively, the alloy product produced by the inventive method possesses superior exfoliation corrosion resistance than prior art alloys on an equivalent cost basis. With reference now to Table VI, a comparison is made between the alloy product practice according to the inventive method with a known prior art alloy product using a T7751 temper. The T7751 temper generally includes aging an AA 7000 series alloy by ramping up to about 250° F. for about 12 hours followed by a second ramping up to about 350° F. for about 1 hour. The partially aged product is then either forced air cooled or, more typically, completely removed from the furnace and quenched in water to reduce the temperature to about 250° F. or less. The quenched product is then put back into the furnace at about 250° F. and further aged. As is evident from Table VI, the product made by the inventive method provides similar mechanical properties to the prior art T7751 alloy product but with equivalent or improved exfoliation resistance as a result of the aging step associated with the inventive method; wherein a single aging step of about 16 hours at 260° F. to 270° F. produces acceptable mechanical properties and excellent exfoliation corrosion resistance. In contrast, the complicated aging process associated with the T7751 prior art alloy product requires a three-step aging process and a quenching step therebetween.

TABLE VI

| | -T7751 | Inventive Method Alloy Product | Standard -T651 or -T6151 |
|---|---|---|---|
| Min. TYS | 77 ksi | 78 ksi | 78 ksi |
| K1C (T-L) | 24 ksi*in-2 | 24 ksi*in-2 | 24 ksi*in-2 |
| EXCO | EB | EB-EA | EC |

The above-mentioned examples illustrate the utility of the inventive method with both 1- and 2-step aging practices in producing tonnage quantities of plate for commercial application. The specific aging practices therein used were selected based on prior art practices so direct, unambiguous comparisons could be made between the product of the inventive method and the product of prior art practices. It is well known in the prior art that during isothermal aging, different times and temperatures can often be selected through Arrehenious relations which result in equivalent material properties. With this in mind, it is important to note that the aging practice used in producing the product of the inventive method can be selected for specific production situations in order to optimize other factors such as furnace turnaround time, total energy use and other economic factors.

A guideline of times and temperatures utilized in aging which would allow practice flexibility and most efficiently produce the desired material characteristics is as follows: Single-step aging at about 220° to 310° F. for about 4 to 72 hours, and two-step aging with the first step at about 220° to 270° F. for about 5 to 32 hours followed by a second step at about 300° F. to 325° F. for about 6 to 24 hours. These times and temperatures of aging are not intended to be all-inclusive but are, rather, guidelines for one skilled in the art to effectively produce the product of the inventive method. In fact, it is probable that aging practices other than one- or two-step practices could produce good properties in the product of the inventive method herein described.

Although the experimental trials are drawn to forming aluminum alloy plate products, any aluminum alloy shape can be used in conjunction with the inventive method. For example, strip, bar, rod, forgings or plate may be selected for processing according to the inventive method of producing an aluminum-based alloy product.

As such, an invention has been disclosed in terms of preferred embodiments thereof which fulfill each and every one of the objects of the present invention as set forth hereinabove and provide a new and improved method of producing an aluminum-based alloy product having improved exfoliation corrosion resistance and fracture toughness.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of producing an aluminum alloy product having superior exfoliation resistance and fracture toughness comprising the steps of:

a) providing an aluminum-based alloy consisting essentially of about 5.5 to 10.0% by weight of zinc, about 1.75 to 2.6% by weight of magnesium, about 1.8 to 2.75% by weight of copper, a maximum of 0.15% by weight of iron, a maximum of 0.12% by weight of silicon, about 0.08 to 0.15% by weight of zirconium, one or more additional grain refining elements selected from chromium, manganese, titanium, boron, vanadium, and hafnium, the total of said additional grain refining elements being between 0.0% and about 0.5% by weight, with the balance aluminum and incidental impurities, wherein the amounts of zinc, copper and magnesium are stoichiometrically balanced in said alloy such that during an aging treatment of said alloy product, substantially all of said copper, magnesium and zinc form $MgZn_2$ and $Al_2CuMg$ precipitates upon reaching equilibrium to produce an alloy product having not more than 0.11 wt. percent excess zinc, copper and magnesium;

b) working said alloy into a predetermined shape;

c) heat treating said predetermined shape;

d) quenching said heat treated shape;

e) aging said heat treated shape for a period of time at an elevated temperature; and f) recovering said aged shape.

2. The method of claim 1 wherein said amounts of zinc, copper and magnesium are stoichiometrically balanced according to a formula defined as:

X equals the amount of magnesium in weight %, Z equals the amount of zinc in weight %, C equals the amount of copper in weight %; and $$Z\,(0.19)=A;$$

$$C\,(0.37)=B;\text{ and}$$

$$T=A+B;$$

wherein

Z, X, and C are selected such that T substantially equals X and said alloy product is essentially free of excess magnesium or copper.

3. The method of claim 1 wherein the amounts of zinc, magnesium and copper in said aluminum-based alloy consist essentially of about 5.8 to 7.1% by weight of zinc, about 1.8 to 2.5% by weight of magnesium and about 2.1 to 2.7% by weight of copper.

4. The method of claim 1 wherein the amounts of zinc, magnesium and copper in said aluminum-based alloy consist essentially of about 6.6 to 6.8% by weight of zinc, about 2.05 to 2.25% by weight of magnesium and about 2.1 to 2.3% by weight of copper.

5. The method of claim I wherein the amounts of zinc, magnesium and copper in said aluminum-based alloy consist essentially of about 6.56% by weight of zinc, about 1.98% by weight of magnesium and about 1.99% by weight of copper.

6. The method of claim 1 wherein the amounts of zinc, magnesium and copper in said aluminum-based alloy consist essentially of about 6.65% by weight of zinc, about 2.08% by weight of magnesium and about 2.21% by weight of copper.

7. The method of claim 1 wherein said aging step consists of aging said heat-treated shape in a first step at about 220°-270° F. for about 5-32 hours followed by aging said heat-treated shape in a second step at about 300°-325° F. for about 6-24 hours.

8. The method of claim 2 wherein said aging step consists of aging said heat-treated shape in a first step at about 220°-270° F. for about 5-32 hours followed by aging said heat-treated shape in a second step at about 300°-325° F. for about 6-24 hours.

9. The method of claim 7 wherein said aging step further comprises a first step of aging said shape for about 9 hours at about 250° F. followed by a second step of aging said heat treated shape for about 9 to 16 hours at about 310° to 315° F.

10. The method of claim 9 wherein said heat treated shape is aged in said second step for about 10 hours.

11. The method of claim 9 wherein said heat treated shape is aged in said second step for about 16 hours.

12. The method of claim 1 wherein said aging step consists of aging said heat-treated shape at about 220°-310° F. for about 4-72 hrs.

13. The method of claim 2 wherein said aging step consists of aging said heat-treated shape at about 220°-310° F. for about 4-72 hrs.

14. The method of claim 12 wherein said aging step consists of aging said heat treated shape at about 260° to 270° F. for about 16 hours.

15. The method of claim 12 wherein the amounts of zinc, copper and magnesium are selected to ensure the absence of excess zinc and magnesium.

16. A method of producing an aluminum alloy product having superior exfoliation resistance and fracture toughness comprising the steps of:

a) providing an aluminum-based alloy consisting essentially of 6.6 to 6.8% by weight of zinc, about 2.05 to 2.25% by weight of magnesium, about 2.1 to 2.3% by weight of copper, a maximum of 0.15% by weight of iron, a maximum of 0.12% by weight of silicon, about 0.08 to 0.15% by weight of zirconium, one or more additional grain refining elements selected from chromium, manganese, titanium, boron, vanadium, and hafnium, the total of said additional grain refining elements being between 0.0% and about 0.5% by weight, with the balance aluminum and incidental impurities, wherein the amounts of zinc, copper and magnesium are stoichiometrically balanced in said alloy such that during an aging treatment of said alloy product, substantially all of said copper, magnesium and zinc form $MgZn_2$ and $Al_2CuMg$ precipitates upon reaching equilibrium to produce an alloy product having not more than 0.11 wt. percent excess zinc, copper and magnesium;

b) working said alloy into a predetermined shape;

c) heat treating said predetermined shape;

d) quenching said heat treated shape;

e) aging said heat treated shape for about 4 to 72 hours at about 220° F. to 310° F.; and f) recovering said aged shape.

17. The method of claim 16 wherein said amounts of zinc, copper and magnesium are stoichiometrically balanced according to a formula defined as:

X equals the amount of magnesium in weight %, Z equals the amount of zinc in weight %, C equals the amount of copper in weight %; and $$Z\,(0.19)=A;$$

$$C\,(0.37)=B;\text{ and}$$

$$T=A+B;$$

wherein

Z, X and C are selected such that T equals X and said alloy product is essentially free of excess magnesium or copper.

18. The method of claim 16 wherein said aging step consists of aging said heat-treated shape at about 260°-270° F. for about 16 hrs.

19. The method of claim 17 wherein said aging step consists of aging said heat-treated shape at about 260°-270° F. for about 16 hrs.

20. The method of claim 16 wherein the amounts of zinc, magnesium and copper in said aluminum-based alloy consist essentially of about 6.65% by weight of zinc, about 2.08% by weight of magnesium and about 2.21% by weight of copper.

21. The method of claim 16 wherein the amounts of zinc, copper and magnesium are selected to ensure the absence of excess zinc and magnesium.

22. A method of producing an aluminum alloy product having superior exfoliation resistance and fracture toughness comprising the steps of a) providing an aluminum-based alloy consisting essentially of 6.6 to 6.8% by weight of zinc, about 2.05 to 2.25% by weight of magnesium, about 2.1 to 2.3% by weight of copper, a maximum of 0.15% by weight of iron, a maximum of 0.12% by weight of silicon, about 0.08 to 0.15% by weight of zirconium, one or more additional grain refining elements selected from chromium, manganese, titanium, boron, vanadium, and hafnium, the total of said additional grain refining elements being between 0.0% and about 0.5% by weight, with the balance aluminum, wherein the amounts of zinc, copper and magnesium are stoichiometrically balanced in said alloy such that during an aging treatment of said alloy product, substantially all of said copper, magnesium and zinc form $MgZn_2$ and $Al_2CuMg$ precipitates upon reaching equilibrium thereby producing an alloy product having not more than 0.11 wt. percent excess zinc, copper and magnesium;

b) working said alloy into a predetermined shape;

c) heat treating said predetermined shape;

d) quenching said heat treated shape;

e) aging said heat treated shape in a first step at about 220° F.–270° F. for about 5 to 32 hours followed by aging said heat treated shape in a second step at about 300° F.–325° F. for 6 to 24 hours; and f) recovering said aged shape.

23. The method of claim 22 wherein said amounts of zinc, copper and magnesium are stoichiometrically balanced according to a formula defined as:

X equals the amount of magnesium in weight %, Z equals the amount of zinc in weight %, C equals the amount of copper in weight %; and $$Z\,(0.19)=A;$$

$$C\,(0.37)=B;\text{ and}$$

$$T=A+B;$$

wherein

Z, X and C are selected such that T equals X and said alloy product is essentially free of excess magnesium or copper.

24. The method of claim 22 wherein said aging step consists of aging said heat-treated shape in a first step at about 250° F. for about 9 hrs. followed by aging said heat-treated shape in a second step at about 310° to 315° F. for about 9–16 hrs.

25. The method of claim 23 wherein said aging step consists of aging said heat-treated shape in a first step at about 250° F. for about 9 hrs. followed by aging said heat-treated shape in a second step at about 310° to 315° F. for about 9–16 hrs.

* * * * *